US008699720B2

(12) United States Patent
Chu

(10) Patent No.: US 8,699,720 B2
(45) Date of Patent: Apr. 15, 2014

(54) HEADPHONES WITH DISTORTION-FREE LOUDNESS LIMITING AND DYNAMIC EQUALIZATION DEVICE

(76) Inventor: Walter Ka Wai Chu, Tai Wai (HK)

( * ) Notice: Subject to any disclaimer, the term of this patent is extended or adjusted under 35 U.S.C. 154(b) by 457 days.

(21) Appl. No.: 12/932,050

(22) Filed: Feb. 15, 2011

(65) Prior Publication Data

US 2011/0200203 A1 Aug. 18, 2011

Related U.S. Application Data

(60) Provisional application No. 61/305,553, filed on Feb. 18, 2010.

(51) Int. Cl.
*H04R 1/10* (2006.01)

(52) U.S. Cl.
USPC ..... 381/74; 381/55

(58) Field of Classification Search
USPC ..... 381/74, 104–107, 56, 55, 111, 381/113–115; 455/569.1; 206/320; 330/253, 289, 287, 297, 199; 333/124, 333/17.3, 32, 110
See application file for complete search history.

(56) References Cited

U.S. PATENT DOCUMENTS 5,208,865 A * 5/1993 Friske et al. ..... 381/94.5
2009/0136061 A1* 5/2009 Osborne ..... 381/107

* cited by examiner

*Primary Examiner* — Xu Mei
*Assistant Examiner* — Ammar Hamid
(74) *Attorney, Agent, or Firm* — Raymond Y. Chan; David and Raymond Patent Firm

(57) ABSTRACT

A headphone assembly for generating an audio output with distortion-free loudness limiting and dynamic equalization feature includes a voltage divider comprising a positive temperature coefficient resistor and a headphone driver, and two audio signal input terminals in each audio channel connected to the voltage divider arranged for connecting to an audio device, wherein a large portion of the voltage of the audio signal to the two audio signal input terminals to appear across the headphone driver in response to the audio signal received through the two audio signal input terminals below a preset low amplitude level; and increasing a resistance of the positive temperature coefficient resistor in a preset non-linear manner and decreasing a voltage drop across the headphone driver accordingly in response to the audio signal received through the two audio signal input terminals which is higher than the preset low amplitude level.

25 Claims, 7 Drawing Sheets

HEADPHONES WITH DISTORTION-FREE LOUDNESS LIMITING AND DYNAMIC EQUALIZATION DEVICE

CROSS REFERENCE OF RELATED APPLICATION

This is a non-provisional application that claims the benefit of priority under 35 U.S.C. §119 to a provisional application, application No. 61/305,553, filed Feb. 18, 2010.

BACKGROUND OF THE PRESENT INVENTION

1. Field of Invention

The present invention relates to a headphone assembly, and more particularly to headphones with distortion-free loudness limiting and dynamic equalization feature.

2. Description of Related Arts

In many applications of headphones, some automatic method of limiting the SPL (Sound Pressure Level) at the opening of the user's ear canals is highly desirable for the purposes of both comfort and hearing conservation. An automatic means is preferred over manual control because manual adjustment of listening volume tends to be less effective because as users listen to audio material, their hearing adapts to the sound level, causing some users increase the SPL as the listening session proceeds. Another reason manual control is less effective is because users sometimes cannot respond quickly enough to rapidly changing amplitudes of sound material to prevent hearing damage.

The prior art in automatic SPL limiting includes both active and passive circuitry to limit SPL. Active circuitry has the drawbacks of requiring a direct current power source and is often bulky.

Passive circuits known to date either simply reduce the efficiency of the headphones or clip the audio drive waveform, introducing severe distortion which makes their use unpleasing and also generates harmonics which results in low frequency power being shifted into higher frequencies where human hearing is more susceptible to damage, further reducing the effectiveness of simple clippers as automatic means of protecting hearing.

SUMMARY OF THE PRESENT INVENTION

The invention is advantageous in that it provides headphones with distortion-free loudness limiting and dynamic equalization feature, offering hearing protection while maintaining or even enhancing the sound quality.

Another advantage of the present invention is to provide a voltage divider including a positive temperature coefficient resistor and a headphone driver, through which the sound pressure level delivered by the headphone driver is controllable in a precise manner.

Another advantage of the present invention is to provide a positive temperature coefficient resistor operatively controlling the sound pressure level delivered by the headphone driver, wherein the resistance of the positive temperature coefficient resistor is increased in a non-linear manner with respect to the impedance of the headphone driver to limiting a power delivered to the headphone driver for automatically limiting a sound pressure level delivered by the headphone driver when the voltage is higher than a preset level.

Another advantage of the present invention is to provide a positive temperature coefficient resistor which has a small thermal mass such that the positive temperature coefficient resistor is promptly responsive to any input amplitude increasing and limiting the sound pressure level delivered by the headphone driver, thereby providing hearing protection and comfort.

Another advantage of the present invention is to provide an encapsulation unit for defining an insulated environment for the positive temperature coefficient resistor such that the positive temperature coefficient resistor is sufficiently insulated from outside and the rate of temperature decrease is minimized, thereby allowing the proper functioning of the positive temperature coefficient resistor for providing hearing protection and perceiving the quality of the audio output.

Another advantage of the present invention is to provide a resonant notch filter which has a preset resonance frequency, preferably at 3.5 kHz, such that a resonant circuit effect is produced at the preset resonance frequency, thereby limiting the power delivered to the headphone driver at the notch frequency for automatically limiting the sound pressure level delivered by the headphone driver at the notch frequency.

Another advantage of the present invention is to provide a high frequency shunt circuit provided on the load side of the positive temperature coefficient resistor for providing a bass boosting response.

Additional advantages and features of the invention will become apparent from the description which follows, and may be realized by means of the instrumentalities and combinations particular point out in the appended claims.

According to the present invention, the foregoing and other objects and advantages are attained by a mono, stereo, or multi-channel headphone assembly for generating an audio output, each audio channel comprising:

two audio signal input terminals defining two open ends of a circuit, arranged for connecting to an audio device which outputs an audio signal such that the circuit is complete and is capable of receiving the audio signal from the audio device to generate the audio output;

a voltage divider connected to the two audio signal input terminals, wherein the voltage divider comprises a positive temperature coefficient resistor having a preset resistance with respect to a preset temperature; and a headphone driver having a preset impedance connected with the positive temperature coefficient resistor in series;

wherein the resistance of the positive temperature coefficient resistor is lower than the impedance of the headphone driver when the audio signal received through the two audio signal input terminals is below a preset low amplitude level such that a large portion of the voltage of the audio signal is applied to the two audio signal input terminals to appear across the headphone driver, wherein the resistance of the positive temperature coefficient resistor is increased in a non-linear manner with respect to the impedance of the headphone driver to limiting a power delivered to the headphone driver for automatically limiting a sound pressure level delivered by the headphone driver, wherein the positive temperature coefficient resistor is capable of self-heating in response to the audio signal which is applied to the two audio signal input terminals through power dissipation, which causes the resistance of the positive temperature coefficient resistor to increase in a non-linear manner with respect to the impedance of the headphone driver, thereby further increasing the power dissipation of the positive temperature coefficient resistor, which further increasing the resistance of the positive temperature coefficient resistor and decreasing the voltage drop across the headphone driver.

In accordance with another aspect of the invention, the present invention is a method of providing an audio output which has the characteristic of distortion-free loudness limiting and dynamic equalization effect through a headphone assembly, comprising the following steps:

(a) providing two audio signal input terminals in each audio channel which is arranged for connecting to an audio device and is capable of receiving an audio signal from the audio device to generate the audio output;

b) connecting a voltage divider to the two signal input terminals, wherein voltage divider comprises a positive temperature coefficient resistor having a preset resistance with respect to a preset temperature; and a headphone driver having a preset impedance connected with the positive temperature coefficient resistor in series;

c) applying a large portion of the voltage of the audio signal to the two audio signal input terminals to appear across the headphone driver in response to the audio to signal received through the two audio signal input terminals below a preset low amplitude level;

d) increasing a resistance of the positive temperature coefficient resistor in a preset non-linear manner and decreasing a voltage drop across the headphone driver accordingly in response to the audio signal received through the two audio signal input terminals which is higher than the preset low amplitude level;

(e) providing a means for power adjustment to control a power input to the headphone driver such that the headphone driver is capable of generating the output signal in response to both low and high amplitude input audio signals;

(f) generating a resonant circuit effect at a preset resonance frequency through a resonant notch filter in such a manner that a shunt impedance on a load side of the positive temperature coefficient resistor is decreased and the self-heating of the positive temperature coefficient resistor is set a maximum at the notch frequency, thereby limiting the power delivered to the headphone driver at the notch frequency for automatically limiting the sound pressure level delivered by the headphone driver at the notch frequency;

(g) limiting the resonant circuit effect through a notch depth limiting resistor;

(h) boosting the sound pressure level at high frequency through a high frequency boost capacitor;

(i) boosting a bass response at frequencies well below the notch frequency through a high frequency shunt circuit; and (j) selectively disabling the bass boosting response through a bass boost switch connected to the high frequency shunt circuit.

Preferably, the positive temperature coefficient resistor has a small thermal mass below a preset level such that the resistance of that the positive temperature coefficient resistor is capable of increasing in a preset manner with respect to the impedance of the headphone driver promptly in response to the increase in amplitude of the input audio signal for providing hearing protection and comfort.

Preferably, the present invention further provides an encapsulation unit enclosing the positive temperature coefficient resistor and defining an insulated environment for the positive temperature coefficient resistor such that the positive temperature coefficient resistor is sufficiently insulated from outside through the insulated environment for minimizing heat loss to the outside and rate of temperature decrease of the positive temperature coefficient resistor such that the rate of decrease of resistance of the positive temperature coefficient resistor is lowered for providing hearing protection and perceiving the quality of the audio output.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 13, a headphone assembly according to a preferred embodiment of the present invention is illustrated.

For clarity, in this document, the figures illustrate one audio channel only. In stereo and other multiple channel audio systems there will be one instance of the circuit shown in the Figures for each audio channel.

Headphone refers an electrodynamic acoustic device for audio playback and is intend to placed near or inside the ear canals of a human. It can be one piece for one side of the ear only, but more commonly (as for music playback) a pair (stereo) for both ears. The term "headphones" in this document is used to describe circumaural (surrounding the ear) headphones, supra-aural (on the ear) headphones, earbuds (that seat in the concha), and canalphones (some people called it in-ear monitors).

Figure 1:
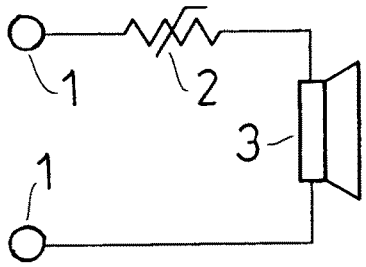
FIG. 1 is a schematic illustration of a circuit configuration for a headphone assembly, i.e. one audio channel of the headphone assembly according to a preferred embodiment of the present invention.

FIG. 1 shows the minimal configuration of the basic invention according to a preferred embodiment of the present invention. Audio signals such as those provided by an MP3 player are received by audio signal input terminals 1 and applied to a voltage divider comprised of positive temperature coefficient resistor 2 and headphone driver 3. For the purpose of this application, headphone driver 3 is an electrodynamic acoustic transducer.

Figure 2:
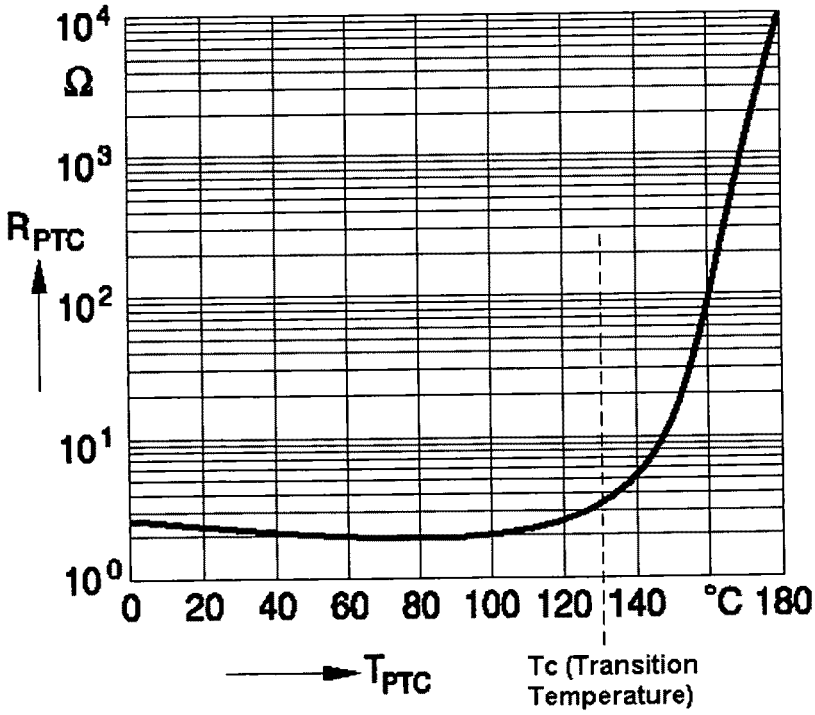
FIG. 2 shows the nonlinear resistance of a positive temperature coefficient resistor, embodied as a barium titanate ceramic based positive temperature coefficient resistor, with respect to its temperature for a headphone assembly according to the above preferred embodiment of the present invention.

FIG. 2 shows the nonlinear resistance of a positive temperature coefficient resistor 2, embodied as a barium titanate ceramic based positive temperature coefficient resistor, with respect to its temperature.

The positive temperature coefficient resistor 2 has a resistance that is not high compared to the impedance of headphone driver 3 when no audio signal or a low amplitude audio signal is applied to audio signal input terminals 1, resulting in a large portion of the voltage of any audio signal applied to audio signal input terminals 1 to appear across headphone driver 3.

As the amplitude of audio signals are applied to audio signal input terminals 1, positive temperature coefficient resistor 2 self-heats because of its power dissipation, and because of its nonlinear increase in temperature and the fact that its resistance increases with respect to the impedance of headphone driver 3, the power dissipated by positive temperature coefficient resistor 2 increases to further increase its own resistance while decreasing the voltage drop across headphone driver 3, which results in a limiting of the power delivered to headphone driver 3, and thereby automatically limiting the SPL delivered by headphone driver 3.

If positive temperature coefficient resistor 2 has sufficiently small thermal mass it will respond quickly to increases in the amplitude of the input audio signal, and that is a desirable characteristic for both hearing protection and comfort.

If positive temperature coefficient resistor 2 is sufficiently insulated from its surroundings, it will recover slowly when the amplitude of the input audio signal decreases, and that is a desirable characteristic for both hearing protection and perceived audio quality.

Positive temperature coefficient resistor 2 can be made of a variety of resistive materials that exhibit positive temperature coefficients of resistance.

Tungsten wire used as the filament in incandescent lamps exhibits this property and can be made very thin so as to have low thermal mass and respond quickly.

Conductive Polymers such as that pioneered by Raychem and used in its Polyswitch series of circuit protectors has a very sharp transition but because of its hysteresis in its transition from low to high resistance, may only be suitable for limited use as a means of limiting audio signal amplitude, and therefore limiting SPL.

Conductive Ceramics, containing barium titanate and/or other chemicals with sharp critical transition temperature, such as those used to limit the current in electrical circuits and self-stabilizing ceramic heating elements can be made in a variety of shapes and sizes and work very well for this application.

There are several ways to obtain the insulation required for the desired slow recovery from the input of a high amplitude audio input signal.

Figure 3:
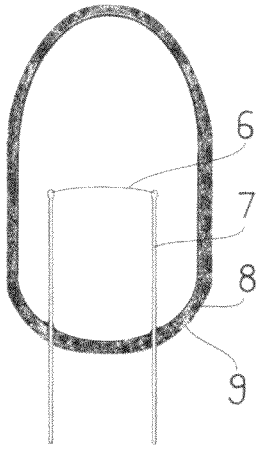
FIG. 3 illustrates the encapsulation and mounting for providing a thermal insulation of a tungsten wire type positive temperature coefficient resistor for a headphone assembly according to the above preferred embodiment of the present invention.

The encapsulation and mounting that provides the best performance for thermal insulation of a tungsten wire is shown in FIG. 3. Tungsten wire 6 is mounted upon connecting leads 7 by crimping or welding. Connecting leads 7 also serve to support Tungsten wire 6.

Tungsten wire 6 is encapsulated in encapsulation means 8 which can be an evacuated or inert gas-filled plastic or preferably glass enclosure, preferably coated on the inside so as to reflect heat back toward the wire. Encapsulation means 8 is preferably further insulated from the ambient environment by insulating means 9 which can be any other thermal insulation material with appropriate temperature rating and thermal insulation qualities, such as polymer foam.

Figure 4:
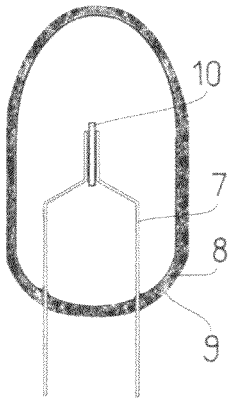
FIG. 4 illustrates the encapsulation and mounting for providing a thermal insulation of a ceramic positive temperature coefficient resistor element for a headphone assembly according to the above preferred embodiment of the present invention.

The encapsulation and mounting that provides the best performance for thermal insulation of a ceramic positive temperature coefficient resistor element is shown in FIG. 4. Ceramic positive temperature coefficient resistor element 10 is equipped with electrodes plated on either side or end of the element and connecting leads 7 attached by either welding or high temperature soldering. Connecting leads 7 also serve to support ceramic positive temperature coefficient resistor element 10.

Ceramic positive temperature coefficient resistor element 10 is encapsulated in encapsulation means 8 which can be an evacuated or dense gas-filled plastic or preferably glass enclosure, preferably coated on the inside so as to reflect heat back toward the wire. Encapsulation means 8 is further insulated from the ambient environment by insulating means 9 which can be styrene-foam, PU-foam, Aerogel, Aerogel-based composites, or any other thermal insulation material with appropriate temperature rating and thermal insulation qualities.

Figure 5:
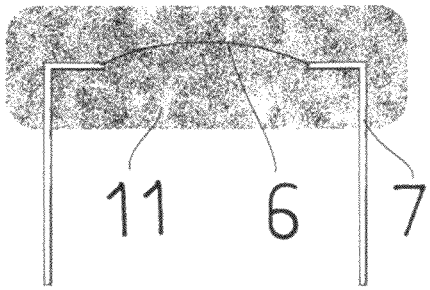
FIG. 5 is illustrates an alternative for providing a thermal insulation of a tungsten wire type positive temperature coefficient resistor for a headphone assembly according to the above preferred embodiment of the present invention.
Figure 6:
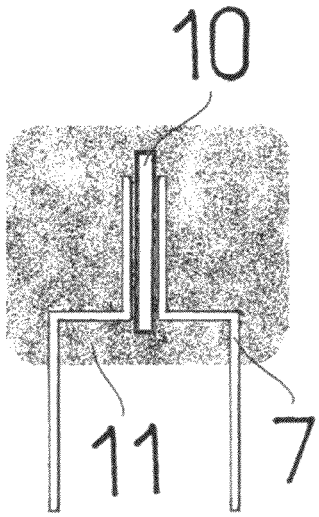
FIG. 6 illustrates an alternative for providing a thermal insulation of a ceramic positive temperature coefficient resistor element for a headphone assembly according to the above preferred embodiment of the present invention.

Design choices that offer the tradeoff of lower performance for lower cost are illustrated in FIG. 5 and FIG. 6.

FIG. 5 shows tungsten wire 6 and connecting leads 7 embedded in insulating block 11, which can be made of insulating material such as Aerogel or other high temperature insulating material.

FIG. 6 shows ceramic positive temperature coefficient resistor element 10 and connecting leads 7 embedded in insulating block 11, which can be made of insulating material such as Aerogel or other temperature insulating material such as styrene-foam.

An even lower cost approach, which yields inferior performance, but perhaps suitable for some extremely cost sensitive applications is to provide no thermal insulation beyond a silicone coating or the ambient air.

It will be apparent to some that active analog circuitry, including that which is powered solely by the audio signal can be used to mimic the behavior and application of positive temperature coefficient resistor 2.

Variations of the Invention to Meet Varying Product Requirements

There exists a variation in product design requirements to meet specific marketing goals and/or production and cost needs. Many variations of and improvements to the basic invention to meet these varied needs are possible.

Figure 7:
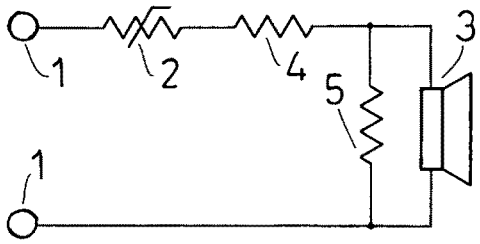
FIG. 7 is a schematic illustration of an alternative circuit configuration for a headphone assembly according to the above preferred embodiment of the present invention.

The basic circuit of FIG. 1 can be modified to allow a variety of different headphone drivers 3 to be adapted to a variety of positive temperature coefficient resistors 2 to assure the proper division of input audio signal voltage by the addition of series resistor 4 and driver shunt resistor 5 as shown in FIG. 7. This arrangement allows for better performance with off-the-shelf parts by helping to assure better distribution of the power during in the presence of both low and high amplitude input audio signals. The values of series resistor 4 and driver shunt resistor 5 are dependent upon the characteristics of positive temperature coefficient resistor 2 and headphone driver 3.

Human ears can tolerate low and high frequency sounds at a higher SPL before hearing impairment occurs, compared to mid-frequency range. Thus, in OSHA Noise Regulation 29 CFR 1910.95, makes use of the A-Weighted sound level curve as shown in 29 CFR 1910.95(a) FIGURE G-9. According to the standard, human ears are least tolerant of high SPL at frequencies near 3.5 kHz. According to 29 CFR 1910.95, the 100 db equal loudness contour allows 7 db greater SPL below 900 Hz and above 8 kHz than it permits at 3.5 kHz.

Figure 8:
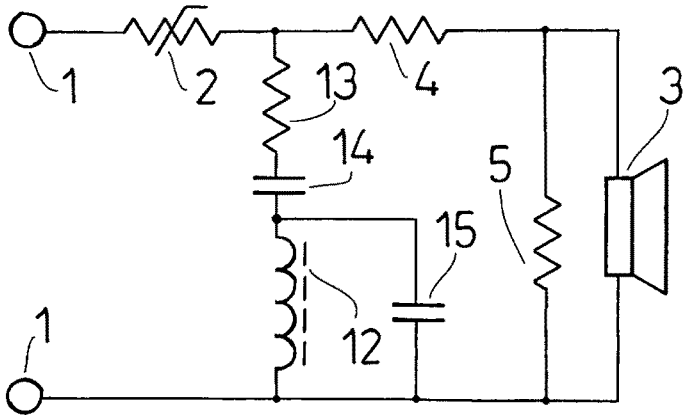
FIG. 8 is a schematic illustration of another alternative circuit configuration for a headphone assembly according to the above preferred embodiment of the present invention.

The circuit improvement shown in FIG. 8 was derived from the circuit shown in FIG. 7 to provide better hearing protection as provided in 29 CFR 1910.95 and to incidentally improve subjective sound quality.

The optional modification utilizes a series resonant circuit at 3.5 kHz, made of resonating inductor 12 and resonating capacitor 14 to decrease the shunt impedance on the load side of positive temperature coefficient resistor 2. There are two beneficial effects of this frequency dependent shut: A notch at 3.5 kHz is created in the frequency response as seen by headphone driver 3, thereby reducing the SPL at that frequency, and since the shunt impedance is lower at the notch frequency, power dissipation and therefore self heating of positive temperature coefficient resistor 2 peaks at the notch frequency, increasing the automatic SPL limiting action in the presence of high amplitude audio signals at the notch frequency.

Notch depth limiting resistor 13 limits the effects of the series resonant circuit.

An additional beneficial optional modification is to add high frequency boost capacitor 15 to increase the perception of sound quality further.

Furthermore, referring to FIG. 8, when it is in low input volume, resistance of PTC device 2 is low, such that the shunting effect of the network composed of 12, 13, 14, and 15 is low, which yields relative flat frequency response on the electrical signal to driver 3. But in high input volume, the resistance of PTC device 2 is high, such that the shunting effect of the network composed of 12, 13, 14, and 15 is high in around 3.5 kHz frequency, so such frequency contents are limited in SPL. Such dynamic frequency equalization gives a very comfortable hearing experience. In other words, there is very clear perception in low volume and reduced mid-high sounds in high volume which will cause a "punching" tones and hearing fatigue after prolong use.

Figure 9:
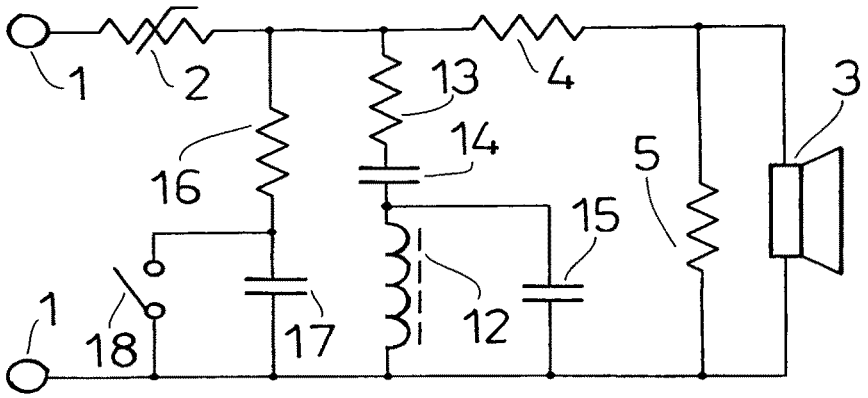
FIG. 9 is a schematic illustration of another alternative circuit configuration for a headphone assembly according to the above preferred embodiment of the present invention.

An additional beneficial improvement, that is more amenable to implementation when used in conjunction when headphone driver 3 has high sensitivity is to add a high frequency shunt circuit on the load side of positive temperature coefficient resistor 2 as shown in FIG. 9. The high frequency is comprised of bass boost resistor 16 and bass boost capacitor 17, selected to boost the bass response at frequencies well below 3.5 kHz.

The effect of the high frequency shunt circuit is to reduce mid- and high-frequencies in proportion to bass frequencies, and this also interacts with the loading on positive temperature coefficient resistor 2 so as to accentuate bass response during loud passages.

Since not all users will prefer the dynamically boosted bass to the more natural sound, bass boost switch 18 can be added to the circuit to remove the dynamic decrease in attenuation of bass frequencies, and thereby disable the dynamic bass boost.

Preferably, the circuit as shown in FIG. 9 is used to illustrate the best mode of the preferred embodiment of the present invention.

Figure 10:
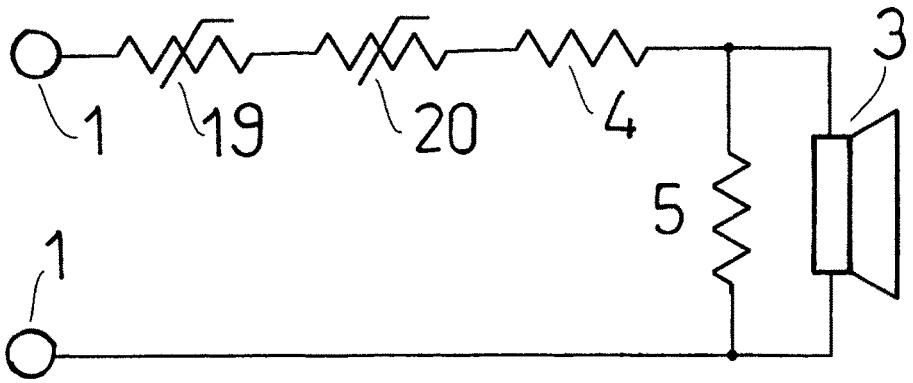
FIG. 10 is a schematic illustration of another alternative circuit configuration for a headphone assembly according to the above preferred embodiment of the present invention.

Further refinement of the invention are possible by taking advantage of the differing characteristics of a combination of multiple elements of differing dimensions and differing materials for positive temperature coefficient resistor 2, such as the circuit shown in FIG. 10. In FIG. 10, tungsten wire positive temperature coefficient resistor 19 provides a faster SPL limiting response, but not as sharply defined SPL a limit as can be provided by ceramic positive temperature coefficient resistor 20; when connected in combination, the benefits of both fast attack and a sharply defined SPL limit can be realized.

The combination of multiple materials and/or multiple geometries to obtain optimized responses and characteristic curves can be obtained with combinations of discrete components or by a single component specially shaped conductors with one or more types of positive temperature coefficient materials.

Figure 11:
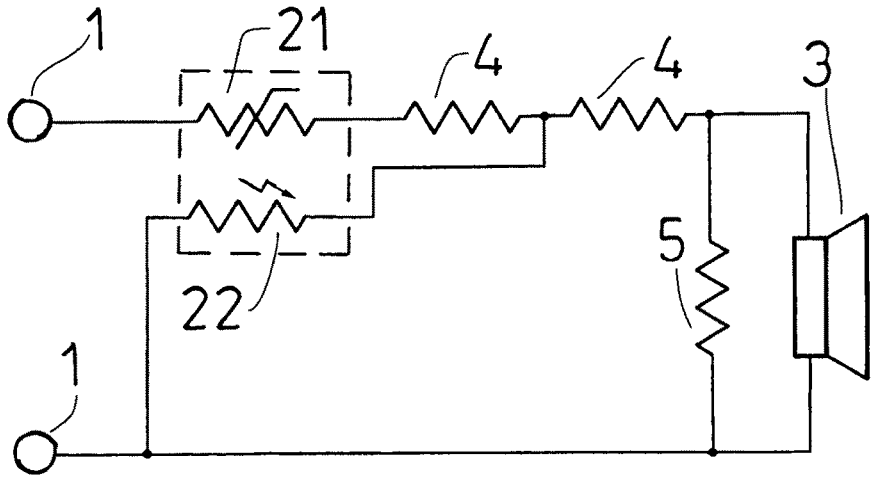
FIG. 11 is a schematic illustration of another alternative circuit configuration for a headphone assembly according to the above preferred embodiment of the present invention.
Figure 12:
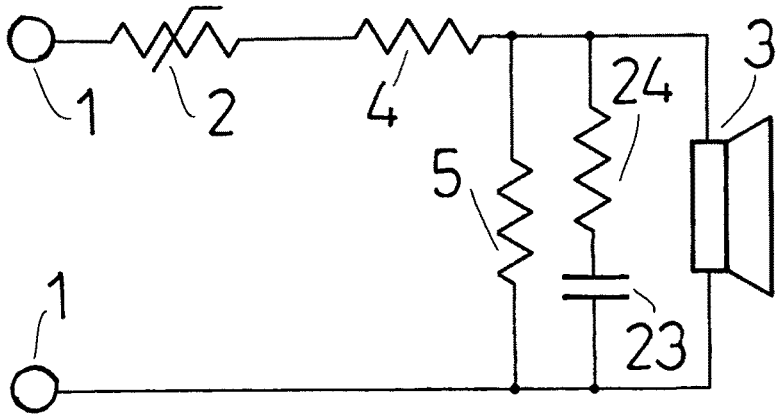
FIG. 12 is a schematic illustration of another alternative circuit configuration for a headphone assembly according to the above preferred embodiment of the present invention.

Referring to FIG. 11, in the case in which fast response is most desirable, the sharpness of the SPL limit obtained from a tungsten wire can be increased by encapsulating the tungsten wire in an inert gas filled or preferably evacuated glass bulb, with tungsten bulb 21 disposed with respect to light dependent resistor 22 in such a way as to cause illumination from tungsten bulb 21 to fall on light dependent resistor 22. As current through tungsten bulb 21 increases, the resistance of light dependent resistor 22 decreases and acting in conjunction with series resistors 4 forms a current controlled attenuator that increases the attenuation as a function of current over that which would be observed in the circuit of FIG. 7 if the circuit of FIG. 7 were to use the same tungsten bulb 21 instead of positive temperature coefficient resistor 2.

It is clear that in cases in which Cadmium cannot be used, other analogous methods can be uses, such as achieving the actions of light dependent resistor 22 and tungsten bulb 21 can be achieved described in the above paragraph can be achieved by using a positive temperature coefficient resistor and a resistive heating element respectively.

Cadmium sulphide is the preferred photoconductor, though there are others. Cadmium sulphide has the favorable characteristic of being much more responsive to visible light than it is to infrared. The increased response when the current through tungsten bulb 21 reaches the point at which the tungsten wire emits visible light adds to the sharpness of the automatic limiting action of the circuit of FIG. 11.

In the case of light dependent resistor 22 being used in the circuit, light dependent resistor 22 can either be a discrete component or the photo resistive material can be applied directly to a printed circuit substrate that is also used for the rest of the circuitry for this invention.

In some systems, the inductive component of the impedance of headphone driver 3 becomes large enough to cause undesirable boost of high frequency performance at higher audio frequencies. The inductive component can be compensated with a so-called Zobel Network or Boucherot Cell which is realized when the series combination of Zobel network capacitor 23 and Zobel network resistor 24 are placed in parallel with headphone driver 3, resulting in the circuit of FIG. 12.

Figure 13:
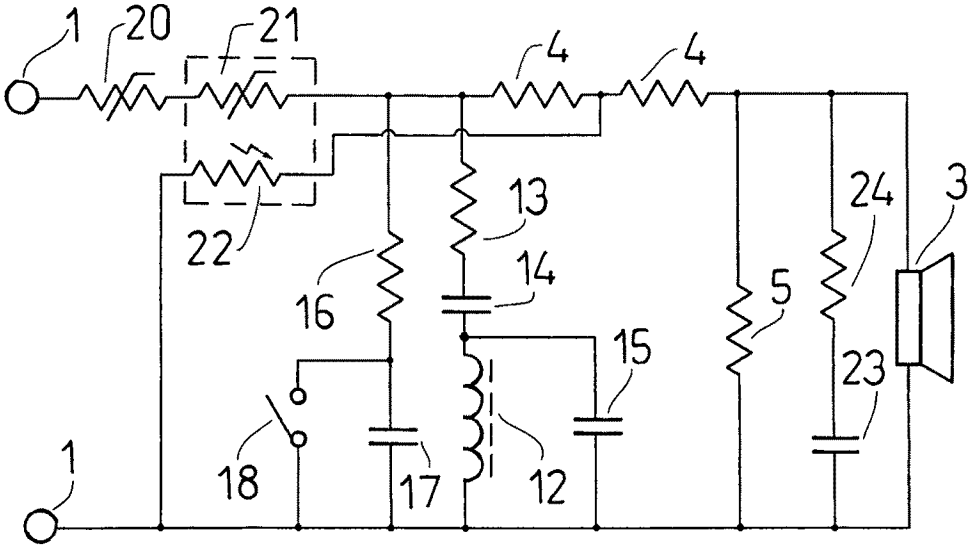
FIG. 13 is a schematic illustration of another alternative circuit configuration for a headphone assembly according to the above preferred embodiment of the present invention.

The circuit that utilizes all of the features of the present invention is shown in FIG. 13.

Preferably, the circuit as shown in FIG. 9 is used to illustrate the best mode of the preferred embodiment of the present invention.

For example, positive temperature coefficient resistor 2 was made by cutting a ceramic positive temperature coefficient resistor part number PR425C050S101H, manufactured by the Precision Positioning Sensors Division of Spectrum Sensors and Controls in Grass Valley, Calif., to a thickness of 0.15 millimeters and with a surface area of 10 millimeters on each face. The resistance at room temperature is approximately 3 Ohms and the resistance when hot is approximately 180 Ohms. It is soldered to connecting leads 7, which is also used to hold it a few millimeters off the printed circuit board.

Below are details of the other components in the preferred embodiment of the present invention.

Audio signal input terminals 1 is a common 3.5 millimeter diameter stereo headphone connector.

Headphone driver 3 is a 32 Ohm ear bud with a sensitivity of 106 to 112 db per milliwatt.

Series resistor 4 is 1.2 Ohms.

Driver shunt resistor 5 is 32 Ohms.

Connecting leads 7 are made of tinned #32 copper alloy wire.

Resonating inductor 12 L1 is 220 microhenries such as part number CB2518T221K manufactured by Taiyo Yuden in Japan.

Notch depth limiting resistor 13 is 1.5 Ohms.

Resonating capacitor 14 is 10 microfarad of MLCC type.

High frequency boost capacitor 15 0.47 microfarad of MLCC type.

Bass boost resistor 16 is 7.5 Ohms.

Bass boost capacitor 17 is 47 microfarads, of MLCC type.

Bass boost switch 18 is a Push-on/Push-off type switch with gold contacts or otherwise treated to make it suitable for switching low power or "dry circuits".

In the preferred embodiment, audio signal input terminals 1, which is a 3.5 millimeter stereo audio plug is connected to a through a flexible, insulated four conductor cable, to a printed circuit board which holds the circuit of FIG. 9 in duplicate; one circuit each for the left and right headphones. The printed circuit board is mounted in a small plastic enclosure, through one surface of which, the actuator for bass boost switch 18 projects.

Two small flexible, insulated two conductor cables connect the printed circuit board to the two headphone drivers 3. Strain reliefs are provided as appropriate.

Alternative embodiments include integrating this invention into audio sources such as MP3 players, computers, and radio receivers, or integrating the invention in its entirety into the headphone assembly which sits atop the user's head, including wireless headphones.

From the foregoing, it will be appreciated by those skilled in the art that the invention is applicable to many different types of headphones from earbuds to surround sound headphones, and that the circuit values can be scaled and optimized for each application. Furthermore, while a preferred embodiment of the invention has been shown and described, it will be apparent to those skilled in the art that changes can be made in the embodiment without departing from the principles and spirit of the invention disclosed above.

The present invention further provides a method of providing an audio output which has the characteristic of distortion-free loudness limiting and dynamic equalization effect through a headphone assembly, comprising the following steps:

a) providing two audio signal input terminals for each audio channel which is arranged for connecting to an audio device and is capable of receiving an audio signal from the audio device to generate the audio output;

b) connecting a voltage divider to the two signal input terminals, wherein voltage divider comprises a positive temperature coefficient resistor having a preset resistance with respect to a preset temperature; and a headphone driver having a preset impedance connected with the positive temperature coefficient resistor in series;

c) applying a large portion of the voltage of the audio signal to the two audio signal input terminals to appear across the headphone driver in response to the audio signal received through the two audio signal input terminals below a preset low amplitude level;

d) increasing a resistance of the positive temperature coefficient resistor in a preset non-linear manner and decreasing a voltage drop across the headphone driver accordingly in response to the audio signal received through the two audio signal input terminals which is higher than the preset low amplitude level;

(e) providing a means for power adjustment to control a power input to the headphone driver such that the headphone driver is capable of generating the output signal in response to both low and high amplitude input audio signals;

(f) generating a resonant circuit effect at a preset resonance frequency through a resonant notch filter in such a manner that a shunt impedance on a load side of the positive temperature coefficient resistor is decreased and the self-heating of the positive temperature coefficient resistor is set a maximum at the notch frequency, thereby limiting the power delivered to the headphone driver at the notch frequency for automatically limiting the sound pressure level delivered by the headphone driver at the notch frequency;

(g) limiting the resonant circuit effect through a notch depth limiting resistor;

(h) boosting the sound pressure level at high frequency through a high frequency boost capacitor;

(i) boosting a base response at frequencies well below the notch frequency through a high frequency shunt circuit; and (j) selectively disabling the base boosting response through a bass boost switch connected to the high frequency shunt circuit.

Preferably, the positive temperature coefficient resistor has a small thermal mass below a preset level such that the resistance of that the positive temperature coefficient resistor is capable of increasing in the preset non-linear manner with respect to the impedance of the headphone driver promptly in response to the increase in amplitude of the input audio signal for providing hearing protection and comfort.

The present invention may further comprise an encapsulation unit enclosing the positive temperature coefficient resistor and defining an insulated environment for the positive temperature coefficient resistor such that the positive temperature coefficient resistor is sufficiently insulated from outside through the insulated environment for minimizing heat loss to the outside and rate of temperature decrease of the positive temperature coefficient resistor such that the rate of decrease of resistance of the positive temperature coefficient resistor is lowered for providing hearing protection and perceiving the quality of the audio output.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A headphone assembly for generating an audio output, comprising:

two audio signal input terminals arranged for connecting to an audio device in order to generate an audio output to a headphone;

a voltage divider connected to said two audio signal input terminals, wherein said voltage divider comprises a positive temperature coefficient resistor having a preset resistance with respect to a preset temperature; and a headphone driver comprising a preset impedance connected with said positive temperature coefficient resistor in series, wherein a resistance of said positive temperature coefficient resistor is increased in a non-linear manner with respect to the impedance of said headphone driver to limit a power delivered to said headphone driver for automatically limiting a sound pressure level (SPL) delivered by said headphone driver.

2. The headphone assembly, as recited in claim 1, wherein said two audio signal input terminals define two open ends of a circuit, arranged for connecting to the audio device which outputs an audio signal such that said circuit is complete and is capable of receiving the audio signal from the audio device to generate the audio output to the headphone, wherein the resistance of said positive temperature coefficient resistor is lower than the impedance of said headphone driver when the audio signal received through said two audio signal input terminals is below a preset low amplitude level such that a large portion of the voltage of the audio signal is applied to said two audio signal input terminals to appear across said headphone driver, wherein said positive temperature coefficient resistor is capable of self-heating in response to the audio signal which is applied to said two audio signal input terminals through power dissipation, which causes the resistance of said positive temperature coefficient resistor to increase in a non-linear manner with respect to the impedance of said headphone driver, thereby further increasing the power dissipation of said positive temperature coefficient resistor, which further increasing the resistance of said positive temperature coefficient resistor and decreasing the voltage drop across said headphone driver.

3. The headphone assembly, as recited in claim 2, wherein said positive temperature coefficient resistor has a small thermal mass below a preset level such that the resistance of that said positive temperature coefficient resistor is capable of increasing in a preset manner with respect to the impedance of said headphone driver promptly in response to the increase in amplitude of the input audio signal for providing hearing protection and comfort.

4. The headphone assembly, as recited in claim 3, further comprising an encapsulation unit enclosing said positive temperature coefficient resistor and defining an insulated environment for said positive temperature coefficient resistor such that said positive temperature coefficient resistor is sufficiently insulated from outside through said insulated environment for minimizing heat loss to the outside and rate of temperature decrease of said positive temperature coefficient resistor such that the rate of decrease of resistance of said positive temperature coefficient resistor is lowered for providing hearing protection and perceiving the quality of the audio output.

5. The headphone assembly, as recited in claim 4, wherein said positive temperature coefficient resistor is a tungsten wire connected through a pair of connecting leads, wherein said encapsulation unit comprises a first member of an evacuated or dense gas-filled plastic enclosing said positive temperature coefficient resistor and a second member of thermal-insulating material further enclosing said first member of said encapsulation unit.

6. The headphone assembly, as recited in claim 4, wherein said positive temperature coefficient resistor is a tungsten wire connected through a pair of connecting leads, wherein said encapsulation unit comprises a first member enclosing said positive temperature coefficient resistor and a second member of thermal-insulating material further enclosing said first member of said encapsulation unit, wherein said first member is a glass enclosure having a coating on an inner surface thereof so as to reflecting a heat towards said positive temperature coefficient resistor for further minimizing heat loss from said positive temperature coefficient resistor.

7. The headphone assembly, as recited in claim 4, wherein said positive temperature coefficient resistor is a conductive ceramic unit connected and supported through a pair of connecting leads, wherein said encapsulation unit comprises a first member of an evacuated or dense gas-filled plastic enclosing said positive temperature coefficient resistor and a second member of thermal insulation material further enclosing said first member of said encapsulation unit.

8. The headphone assembly, as recited in claim 4, wherein said positive temperature coefficient resistor is a conductive ceramic unit connected and supported through a pair of connecting leads, wherein said encapsulation unit comprises a first member enclosing said positive temperature coefficient resistor and a second member of thermal insulation material further enclosing said first member of said encapsulation unit, wherein said first member is a glass enclosure having a coating on an inner surface thereof so as to reflecting a heat towards said positive temperature coefficient resistor for further minimizing heat loss from said positive temperature coefficient resistor.

9. The headphone assembly, as recited in claim 4, wherein said encapsulation unit is a made of an insulating material which supports and embeds said positive temperature coefficient resistor.

10. The headphone assembly, as recited in claim 4, further comprising a power adjustment unit to control a power input to said headphone driver, wherein said power adjustment unit comprises a series resistor connected in series with said positive temperature coefficient resistor, and a driver shunt resistor connected in parallel with said headphone driver such that the current passing through said positive temperature coefficient resistor and the power input to said headphone driver are controllable through said power adjustment unit, thereby said headphone driver is capable of generating the output signal in response to both low and high amplitude input audio signals.

11. The headphone assembly, as recited in claim 10, further comprising a resonant circuit at 3.5 kHz connected in parallel with respect to said headphone driver to provide a resonant circuit effect in which a shunt impedance on a load side of said positive temperature coefficient resistor is decreased, wherein said resonant circuit comprises a resonating inductor connected in series with a resonating capacitor such that a notch frequency at 3.5 kHz is capable of being created for reducing the sound pressure level at 3.5 kHz and the self-heating of said positive temperature coefficient resistor is set a maximum at the notch frequency, thereby limiting the power delivered to said headphone driver at the notch frequency for automatically limiting the sound pressure level delivered by said headphone driver at the notch frequency.

12. The headphone assembly, as recited in claim 11, wherein said resonant circuit further comprises a notch depth limiting resistor connected in series with said resonance capacitor and said resonating inductor so as to limiting the resonant circuit effect of said resonant circuit.

13. The headphone assembly, as recited in claim 4, further comprising a resonant notch filter connected in parallel with respect to said headphone driver which has a preset resonance frequency such that a resonant circuit effect is produced at the preset resonance frequency in which a shunt impedance on a load side of said positive temperature coefficient resistor is decreased and the self-heating of said positive temperature coefficient resistor is set a maximum at the notch frequency, thereby limiting the power delivered to said headphone driver at the notch frequency for automatically limiting the sound pressure level delivered by said headphone driver at the notch frequency.

14. The headphone assembly, as recited in claim 12, further comprising a high frequency boost capacitor connected in parallel with respect to said resonating inductor, wherein a capacitance of said high frequency boost capacitor is smaller than a capacitance of said resonance capacitor so as to boost the sound pressure level at high frequency within a range of 10-12 kHz for improving sound quality.

15. The headphone assembly, as recited in claim 13, wherein said resonant notch filter consists of a notch depth limiting resistor, a resonance capacitor and a resonating inductor connected in series and in sequence, wherein said resonant filter further consists of a high frequency boost capacitor connected in parallel with respect to said resonating inductor, wherein a capacitance of said high frequency boost capacitor is smaller than a capacitance of said resonance capacitor so as to boost the sound pressure level within a preset range of frequency for improving sound quality at high frequency.

16. The headphone assembly, as recited in claim 14, further comprising a high frequency shunt circuit provided on the load side of said positive temperature coefficient resistor arranged for boosting a bass response at frequencies well below 3.5 kHz.

17. The headphone assembly, as recited in claim 15, further comprising a high frequency shunt circuit provided on the load side of said positive temperature coefficient resistor arranged for providing a bass boosting response.

18. The headphone assembly, as recited in claim 16, further comprising a bass boost switch connected to said high frequency shunt circuit for selectively switching off said high frequency shunt circuit so as to disabling the base boosting response.

19. A method of providing an audio output which has the characteristic of distortion-free loudness limiting and dynamic equalization effect through a headphone assembly, comprising the steps of:

a) providing two audio signal input terminals which is arranged for connecting to an audio device and is capable of receiving an audio signal from the audio device to generate the audio output;

b) connecting a voltage divider to said two signal input terminals, wherein said voltage divider comprises a positive temperature coefficient resistor having a preset resistance with respect to a preset temperature; and a headphone driver having a preset impedance connected with said positive temperature coefficient resistor in series;

c) applying a large portion of the voltage of the audio signal to said two audio signal input terminals to appear across said headphone driver in response to the audio signal received through said two audio signal input terminals below a preset low amplitude level; and d) increasing a resistance of said positive temperature coefficient resistor in a preset non-linear manner with respect to the impedance of said headphone driver to limit a power delivered to said headphone driver for automatically limiting a sound pressure level (SPL) delivered by said headphone driver, and decreasing a voltage drop across said headphone driver accordingly in response to the audio signal received through said two audio signal input terminals which is higher than the preset low amplitude level.

20. The method, as recited in claim 19, wherein said positive temperature coefficient resistor has a small thermal mass below a preset level such that the resistance of that said positive temperature coefficient resistor is capable of increasing in the preset non-linear manner with respect to the impedance of said headphone driver promptly in response to the increase in amplitude of the input audio signal for providing hearing protection and comfort.

21. The headphone assembly, as recited in claim 20, further comprising an encapsulation unit enclosing said positive temperature coefficient resistor and defining an insulated environment for said positive temperature coefficient resistor such that said positive temperature coefficient resistor is sufficiently insulated from outside through said insulated environment for minimizing heat loss to the outside and rate of temperature decrease of said positive temperature coefficient resistor such that the rate of decrease of resistance of said positive temperature coefficient resistor is lowered for providing hearing protection and perceiving the quality of the audio output.

22. The method, as recited in claim 19, further comprising a step of: (e) providing a means for power adjustment to control a power input to said headphone driver such that said headphone driver is capable of generating the output signal in response to both low and high amplitude input audio signals.

23. The method, as recited in claim 22, further comprising a step of: (f) generating a resonant circuit effect at a preset resonance frequency through a resonant notch filter in such a manner that a shunt impedance on a load side of said positive temperature coefficient resistor is decreased and the self-heating of said positive temperature coefficient resistor is set a maximum at the notch frequency, thereby limiting the power delivered to said headphone driver at the notch frequency for automatically limiting the sound pressure level delivered by said headphone driver at the notch frequency.

24. The method, as recited in claim 23, further comprising the steps of: (g) limiting the resonant circuit effect through a notch depth limiting resistor, and (h) boosting the sound pressure level at high frequency through a high frequency boost capacitor.

25. The method, as recited in claim 24, further comprising the steps of: (i) boosting a bass response at frequencies well below the notch frequency through a high frequency shunt circuit; and (j) selectively disabling the bass boosting response through a bass boost switch connected to said high frequency shunt circuit.

* * * * *